United States Patent [19]

Theurer et al.

[11] Patent Number: 4,911,246

[45] Date of Patent: Mar. 27, 1990

[54] BALLAST CLEANING MACHINE

[75] Inventors: Josef Theurer, Vienna; Manfred Brunninger, Altenberg, both of Austria

[73] Assignee: Franz Plasser Bahnbaumaschinen-Industriegesellschaft m.b.H., Vienna, Austria

[21] Appl. No.: 158,791

[22] Filed: Feb. 22, 1988

[30] Foreign Application Priority Data

May 27, 1987 [AT] Austria ..... A1359/87

[51] Int. Cl.[4] ..... E01B 27/00

[52] U.S. Cl. ..... 171/16; 104/7.1; 104/7.3

[58] Field of Search ..... 171/16; 104/2, 7.1, 104/7.3, 279

[56] References Cited

U.S. PATENT DOCUMENTS

| | | | |
|---|---|---|---|
| 3,426,379 | 2/1969 | Holley | 171/16 |
| 3,690,262 | 9/1972 | Plasser et al. | 104/7 R |
| 4,211,170 | 7/1980 | Theurer | 104/7.3 |
| 4,316,416 | 2/1982 | Theurer et al. | 171/16 |
| 4,538,686 | 9/1985 | Theurer et al. | 171/16 |
| 4,538,687 | 9/1985 | Theurer et al. | 171/16 |

FOREIGN PATENT DOCUMENTS

| | | | |
|---|---|---|---|
| 239712 | 10/1987 | European Pat. Off. | 171/16 |
| 931887 | 5/1982 | U.S.S.R. | 171/16 |

*Primary Examiner*—Robert E. Garrett
*Assistant Examiner*—Therese M. Newholm
*Attorney, Agent, or Firm*—Kurt Kelman

[57] ABSTRACT

A ballast cleaning machine comprises a machine frame comprising two frame parts, one of the ends of one machine frame part adjoining one of the ends of the other machine frame part while the machine frame part ends opposite to the one ends are remote from each other, and the adjoining machine frame part ends being pivotally linked to each other for pivoting about a vertical axis. Respective undercarriages support the machine frame on the track, two of the undercarriages being arranged at the remote machine part ends and a third one of the undercarriages being arranged on one of the machine frame parts in the range of the vertical pivoting axis. An endless ballast excavating chain is arranged on a first machine frame part, the chain including a transverse section extending for operation under the track, a ballast screening arrangement is arranged to receive excavated ballast from the chain, and a track lifting device is arranged on the first machine frame part adjacent the transverse ballast excavating chain section. A drive connects the third undercarriage to the one machine frame part whereon it is arranged for longitudinally displacing the third undercarriage whereby the spacing between the third undercarriage and the track lifting device may be varied.

7 Claims, 1 Drawing Sheet

BALLAST CLEANING MACHINE

BACKGROUND OF THE INVENTION (1) Field of the Invention

The present invention relates to a ballast cleaning machine for excavating ballast from underneath a track and for receiving, cleaning and transporting the excavated ballast, which comprises a machine frame comprising two frame parts, each machine frame part having opposite ends, one of the ends of one machine frame part adjoining one of the ends of the other machine frame part while the machine frame part ends opposite to the one ends are remote from each other, and the adjoining machine frame part ends being pivotally linked to each other for pivoting about a vertical axis. Respective undercarriages support the machine frame on the track, two of the undercarriages being arranged at the remote machine part ends and a third one of the undercarriages being arranged on one of the machine frame parts in the range of the vertical pivoting axis. An endless ballast excavating chain is arranged on a first one of the machine frame parts, the chain including a transverse section extending for operation under the track, a ballast screening arrangement is arranged to receive excavated ballast from the chain, and a track lifting device is arranged on the first machine frame part adjacent the transverse ballast excavating chain section.

(2) Description of the Prior Art

U.S. Pat. No. 4,538,686, dated Sept. 3, 1985, discloses a self-propelled ballast cleaning machine which comprises a machine frame whose opposite ends are supported by undercarriages on the track. Arranged between the machine frame ends are an endless ballast excavating chain including a transverse section for operation under the preferably lifted track, a track lifting device and a ballast screening arrangement arranged to receive the excavated ballast from the chain. The track lifting stroke is limited by the two undercarriages at the opposite ends of the machine frame so that it may not be possible to lift the track sufficiently for accommodating the transverse chain section therebelow in track sections which have a relatively shallow ballast bed. On the other hand, a longer wheel base, which would enable the track lifting stroke between the undercarriages to be correspondingly increased, causes the endless ballast excavating chain to extend in track curves laterally beyond the track during movement of the machine between operating sites.

U.S. Pat. No. 4,538,687, dated Sept. 3, 1985, discloses a ballast cleaning machine comprising a tripartite machine frame, the adjoining ends of the machine frame parts being pivotally linked to each other for pivoting about vertical axes. The machine frame of this high-efficiency machine is supported on the track by undercarriages arranged at the remote ends of the two outer machine frame parts as well as in the range of the pivotal links of the outer machine frame parts with the intermediate machine frame part. The intermediate, bridge-like machine frame part carries an endless ballast excavating chain including a transverse section for operation under the preferably lifted track, a track lifting device and a high-capacity ballast screening arrangement arranged to receive the excavated ballast from the chain. A retractible auxiliary undercarriage is mounted on the intermediate machine frame part ahead of the ballast excavating chain in the operating direction of the machine for use only during movement of the machine between operating sites. A vertical adjustment drive for this retractible undercarriage is arranged in the range of the pivotal link between the intermediate and leading machine frame parts to enable the front end of the intermediate machine frame part with this undercarriage to be vertically adjusted with respect to the leading machine frame part and the track. In this way, the distance between the two undercarriages wherebetween the track lifting device is arranged may be increased during operation of the machine to insure sufficient lifting of the track. On the other hand, lowering of the retractible undercarriage into engagement with the track enables the machine frame to be properly supported on the track so that the machine may be incorporated into a train for movement between operating sites while assuring that the excavating chain will not unduly extend laterally beyond the track in sharp track curves. To enable the transverse ballast excavating chain section, which has a considerable height to increase its excavating capacity, to be inserted under the track even if the ballast bed is too shallow to permit a normal lift of the track, a continuously operating ballast tamping arrangement is mounted on the leading machine frame part to increase the height of the bed. This lifting of the track ties by tamping ballast under them ahead of the ballast excavation has been very successfully used in commercial track rehabilitation but requires the additional tamping stage. An increased lifting stroke can be effected by the track lifting device only if the undercarriages were spaced farther apart but this would cause the transverse chain section to extend unduly beyond the track in sharp curves.

U.S. Pat. No. 3,690,262, dated Sept. 12, 1972, relates to a track rehabilitation technology fundamentally different from ballast cleaning, i.e. it discloses a track correction and tamping machine with an elongated machine frame supported on undercarriages, the wheel base of the machine being extensible for improving the track lift during tamping and track repositioning. For this purpose, the tamping and track lifting unit is mounted between a rear and intermediate undercarriage, an additional front undercarriage being longitudinally and vertically adjustably mounted at a front end of the machine frame. During operation of the tamper, this front undercarriage is longitudinally displaced into a forward position and lowered into engagement with the track, while the intermediate undercarriage is lifted out of engagement with the track so that the track is freely movable at this point. This structure increases the track lifting stroke of the tamper lifting unit and enables additional ballast to be tamped under the ties.

SUMMARY OF THE INVENTION

It is the object of this invention to improve a ballast cleaning machine of the first-described type so that the track may be lifted higher between relatively widely spaced undercarriages whereby the insertion of the transverse ballast excavating chain section under the track is facilitated while, at the same time, the endless ballast excavating chain and, more particularly, its transverse section, will remain within the lateral boundaries of the track, even in sharp track curves.

The above and other objects are accomplished in such a machine according to the invention with a drive connecting the third undercarriage to the one machine frame part whereon it is arranged for longitudinally displacing the third undercarriage whereby the spacing between the third undercarriage and the track lifting device may be varied.

Such a ballast cleaning machine with a longitudinally displaceable undercarriage is structurally very simple since the machine frame parts carrying very heavy loads as well as the pivotal links connecting these frame parts are in no way affected by the structure which enables the wheel base to be varied. The longitudinal displacement of the third undercarriage enables the ballast cleaning machine to be simply and rapidly adapted to the prevailing operating conditions to change the track lifting stroke without interfering with the ballast cleaning operation. For moving the machine between operating sites, the third undercarriage may be rapidly displaced by remote control of its drive into an end position closest to the track lifting device. This prevents laterally projecting portions, particularly the ballast excavating chain, from extending laterally beyond the lateral boundaries of the track and also complies with official regulations regarding maximal wheel bases for railroad cars.

BRIEF DESCRIPTION OF THE DRAWING

The above and other objects, advantages and features of the present invention will become more apparent from the following detailed description of a now preferred embodiment thereof, taken in conjunction with the accompanying, somewhat schematic drawing wherein.

DESCRIPTION OF PREFERRED EMBODIMENTS

Figures 1, 2, 3, 4:
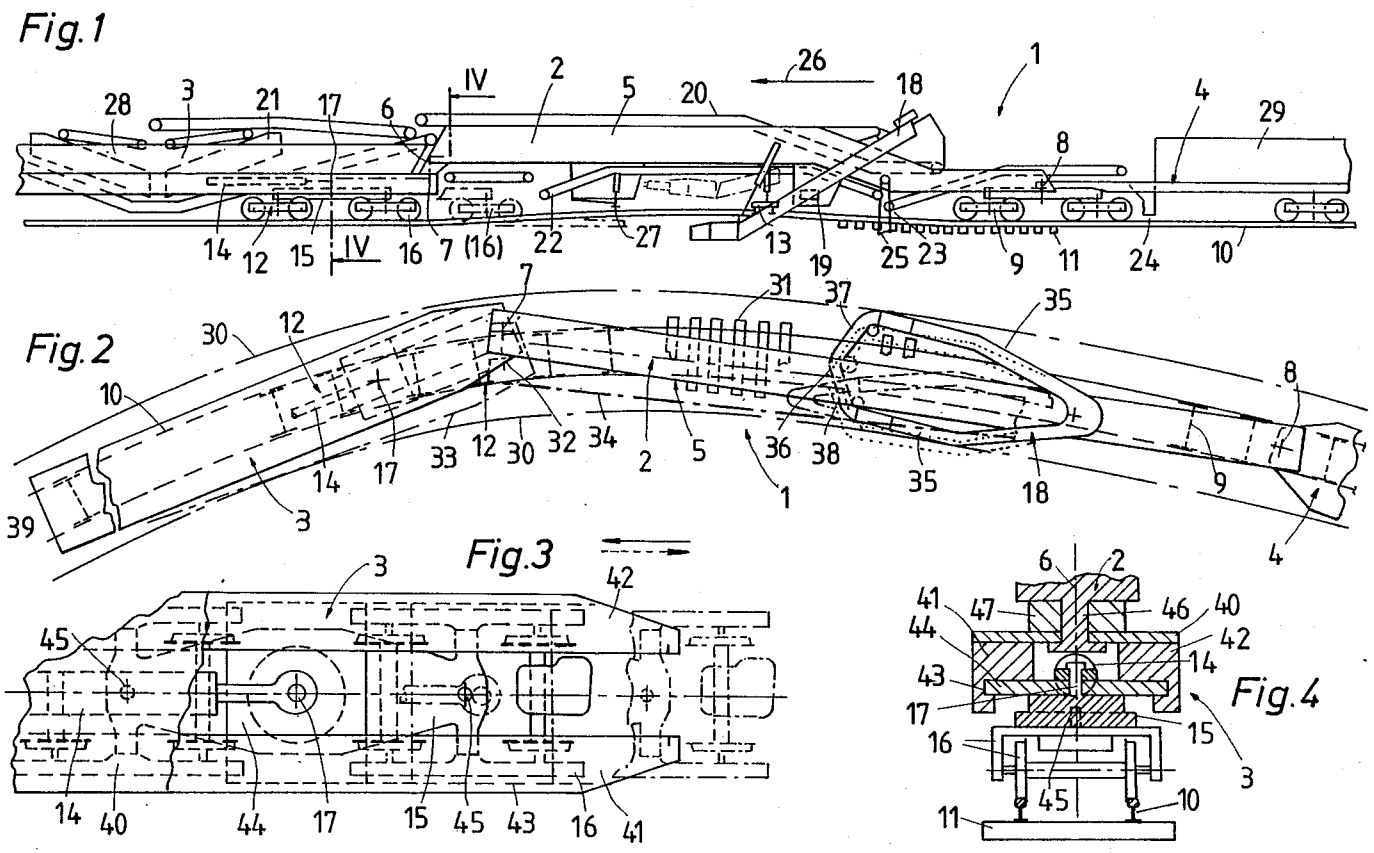
FIG. 1 is a partial side elevational view of a ballast cleaning machine with a longitudinally displaceable undercarriage.
FIG. 2 is a top view of the ballast cleaning machine of FIG. 1.
FIG. 3 is an enlarged fragmentary top view of a portion of the machine incorporating the longitudinally displaceable undercarriage.
FIG. 4 is a cross section along line IV—IV of FIG. 1.

Referring now to the drawing, there is shown ballast cleaning machine 1 for excavating ballast from underneath a track comprised of rails 10 fastened to tie 11 and for receiving, cleaning and transporting the excavated ballast. The machine comprises elongated machine frame 5 comprising first frame part 2 intermediate one leading frame part 3 and another rear frame part 4, as seen in the operating direction of machine 1 indicated by arrow 26. Each machine frame part has opposite ends and one of the ends of one machine frame part adjoins one of the ends of an adjacent one of the machine frame parts while the machine frame part ends opposite to the one ends are remote from each other. The adjoining ends of machine frame parts 2 and 3 are pivotally linked to each other at pivotal link 7 for pivoting about vertical axis 6 which the adjoining ends of machine frame parts 2 and 4 are pivotally linked to each other at pivotal link 8 for pivoting about a vertical axis. Respective undercarriages support machine frame 5 on the track, two of the undercarriages being arranged at the remote machine part ends and a third undercarriage being arranged on one of the machine frame parts in the range of the vertical pivotal axis.

As shown, an undercarriage constituted by four-axle swivel truck 9 supports the rear end of intermediate machine frame part 2, which is linked to rear machine frame part 4, on the track while undercarriage 39 supports a front end of leading machine frame part 3 on the track. Third undercarriage 12 is arranged on machine frame part 3 in the range of vertical pivoting axis 6 and hydraulic drive 14 connects the third undercarriage to machine frame part 3 for longitudinally displacing the third undercarriage in the direction of track elongation. Endless ballast excavating chain 18 is arranged on first machine frame part 2 and includes transverse section 36 extending for operation under the track and ballast screening arrangement 28 is arranged to receive ballast from chain 18. Track lifting device 13 is arranged on first machine frame part 2 adjacent transverse ballast excavating chain section 36 and undercarriage 12 leads the track lifting device in the operating direction of the machine. The longitudinal displacement of third undercarriage 12 enables the spacing between the third undercarriage and track lifting device 13 to be varied.

In the illustrated embodiment, third undercarriage 12 comprises two swivel trucks 16 and carrier plate 15 connecting the swivel trucks. Undercarriage 12 has a pivot pin whereby the undercarriage is rotatable about vertical axis 17, and drive 14 is arranged for longitudinally displacing the third undercarriage between a first position (shown in chain-dotted lines in FIG. 1) for moving machine 1 between operating sites, wherein vertical axes 6 and 17 are coaxial and vertical rotating axis 17 of the third undercarriage extends below vertical pivoting axis 6 of machine frame parts 2 and 3, and a second position (shown in full lines in FIG. 1) for operating machine 1 at respective operating sites, wherein vertical rotating axis 17 of third undercarriage 12 leads vertical pivoting axis 6 of machine frame parts 2 and 3 in the operating direction of the machine. This positioning of the third undercarriage during operation of the machine has the particular advantage of enabling the pivotal link of the machine parts to be displaced from the center of the track towards the curvature of the track even in sharp curves. This lateral displacement of the first machine frame part towards the outer rail, i.e. in the direction of the track curvature, enables the ballast excavating chain to be displaced even further in that same direction so that the track may be subtended even in sharp curves within the lateral boundaries of the track despite the wide spacing between the undercarriages.

An operator's cab holding central control panel 19 for an operator of the ballast cleaning machine is mounted on first machine frame part 2 within range of endless ballast excavating chain 18. Ballast screening arrangement 28 consisting of two successive ballast screens 21 is arranged to receive excavated ballast from chain 18, conveyor band arrangement 20 conveying the excavated ballast from an output of the endless ballast excavating chain to a respective ballast screen. As shown in the drawing, third undercarriage 12 is arranged at a rear end of machine frame part 3, in the operating direction of the machine, and ballast screening arrangement 28 is mounted on this leading machine frame part. By using this machine frame part as a ballast screening car, first machine frame part 2 is relieved of carrying the heavy weight of the ballast screens and the track lift may be effected without problems. Arranging the third undercarriage on machine frame part 3 provides a stable support for this heavily loaded machine frame part in each position of this displaceable undercarriage.

Cleaned ballast distributing conveyor band arrangement 22 is mounted on the underside of first machine frame part 2 for conveying the cleaned ballast from a respective ballast cleaning screen 21 to respective discharge points 23 and 24 behind the ballast excavating chain to distribute the cleaned ballast in the excavated ballast bed. Ballast compacting beam 25 is arranged at first discharge point 23 to compact the discharged cleaned ballast, the ballast compacting means being supported on machine frame part 2 for pivoting about an axis extending transversely to the longitudinal extension of this machine frame part. Vertically adjustable auxiliary track gripping clamp 27 is mounted on machine frame part 2 immediately ahead of endless ballast excavating chain 18, in the operating direction of the machine, the track gripping clamp comprising a pair of cooperating lifting plates pivotal into engagement with a respective rail 10 by subtending the rail head. Trailing machine frame part 4 carries not only second discharge point 24 comprising a transversely extending chute for depositing cleaned ballast in the cribs but also central power plant 29 for providing power to the operating drives of machine 1.

FIG. 2 shows lateral boundaries 30 of the track in chain-dotted lines. For proper operation of the machine along a track section, no structural component of the machine must project beyond these boundary lines. As shown in the drawing, all three machine frame parts 2, 3, 4 and endless ballast excavating chain 18, which surrounds track 31, are within the indicated lateral boundaries. Longitudinally displaceable third undercarriage 12 has been displaced into its forward position, which causes the rear end of leading machine frame part 3 to be moved laterally outwardly in the illustrated track curve in the direction of the curvature while pivotal link 7 between machine frame parts 2 and 3 is moved from its central position between rails 10 in the same direction. This has the advantage that elongated machine frame part 2, which forms a chord in the track curve, is also laterally displaced in this direction, which enables endless ballast excavating chain 18 to be extended in this direction for properly encompassing track 31 while machine frame part 2 and chain 18 remain with lateral boundaries 30. When machine 1 is moved between operating sites, longitudinally displaceable third undercarriage 12 is in its rear position indicated in chain-dotted lines and pivotal link 7 between machine frame parts 2 and 3 is centered between the rails in the position indicated by reference numeral 32. In this position, the vertical axis of pivot pin 17 of undercarriage 12 is coaxial with vertical axis 6 of pivotal link 7. Chain-dotted lines 33 and 34 indicate the positions of machine frame parts 3 and 2 when the machine is moved between operating sites.

As is also shown in FIG. 2, endless ballast conveying chain 18 comprises two longitudinally extending, upwardly inclined sections 35 linked to transverse section 36 which extends below track 31 for excavating the ballast and conveying the excavated ballast upwardly to an output of the chain whence it is conveyed by conveyor band arrangement 20 to ballast screening arrangement 28. Transverse chain section 36 consists of two parts 37 and 38 whose adjoining ends are linked to each other for pivoting about a vertical axis whereby longitudinally extending chain sections 35 may be pivoted into a position closely adjacent respective sides of machine frame part 2 whereon the chain is mounted. Thus, when the machine is moved between operating sides, chain 18 may be collapsed without dismantling the same into the position shown in chain-dotted lines in FIG. 1, wherein the longitudinall extending chain sections hug the sides of machine frame part 2 and are within lateral boundaries 30. A theoretical operating position of endless ballast excavating chain 18 is indicated in dotted lines to show that the extended chain would project beyond lateral boundaries 30 of the track if first machine frame part 2 were not displaced laterally outwardly into the operating position shown in full lines but were in the position indicated by chain-dotted lines 34, which is the position assumed when the machine is moved between operating sites, i.e. when longitudinally displaceable undercarriage 12 is in its rear position.

As shown in FIGS. 3 and 4, machine frame part 3 is comprised of two carrier beams 41, 42 extending parallel to each other and interconnected by bottom plate 40. Each carrier beam defines a guide track of U-shaped cross section forming longitudinally extending guide 43 glidingly receiving the two side edges of support plate 44 connected to longitudinal displacement drive 14. Carrier plate 15, which connects the two swivel trucks 16 of undercarriage 12, extends below support plate 44 and pivot pin 17 mounts the carrier plate rotatably about a vertical axis on the support plate. Each swivel truck 16 is rotatably mounted on carrier plate 15 by pivot pin 45 for rotation about a vertical axis. Such a four-axle undercarriage provides a very stable support for a very heavy load while, on the other hand, enabling the undercarriage to be longitudinally displaced without any problems. The U-shaped guide tracks provide a solid gliding support for the support plate of the undercarriage on the machine frame part in every longitudinal position of the undercarriage.

It is advantageous for the longitudinal displacement path of undercarriage 12 to correspond to the spacing between pivot pins 45 of swivel trucks 16 so that a stable support is provided for the very heavy machine frame part 3 in track curves even in the outermost end positions of the longitudinally displaceable undercarriage.

As best shown in FIG. 4, carrier plate 15 for swivel trucks 16 is freely rotatable on support plate 44 by pivot pin 17 so that the two swivel trucks may readily follow the path of rails 10, regardless of the longitudinal orientation of machine frame part 3. Pivotal link 7 coupling machine frame parts 2 and 3 is a pivot pin 46 projecting downwardly from frame part 2 and extending through bottom plate 40 of frame part 3. Gliding bearing 47 is interposed between frame part 2 and bottom plate 40.

Ballast cleaning machine 1 may be operated in the following manner:

The machine is moved on the track to an operating site while the operator at control panel 19 supplies power from power plant 29 to drive 14 to hold undercarriage 12 in its rearmost end position shown in chain-dotted lines in FIG. 1. During this movement of the machine, endless ballast excavating chain 18 is in its raised and collapsed position shown in chain-dotted lines in FIGS. 1 and 2, wherein longitudinally extending chain sections 35 are close to the sides of first machine frame part 2. Pivoting axis 6 is centered between rails 10 during this movement since pivot pin 17 of undercarriage 12 is coaxial with the pivoting axis. The length of machine frame part 2, i.e. the distance between pivot links 7 and 8 respectively coupling the opposite ends of this machine frame part to leading machine frame part 3 and trailing machine frame part 4, is such that the machine frame part ends will not project beyond lateral boundaries 30 of the track even in the sharpest track curves.

After the operating site has been reached, drive 14 is actuated by the operator to displace the same longitudinally into its foremost end position shown in full lines in FIG. 1, which is its position during the operation of the machine. The two rails 10 are cut in the plane of transverse chain section 36 and the track section ahead of the cutting plane in the operating direction of the machine is raised by auxiliary track gripping clamps 27, which are pivoted into engagement with rails 10 and lifted. While the ballast under this raised track section is removed, a pivoting drive interconnecting the two transverse chain section parts 37, 38 is actuated to pivot the two transverse chain section parts until the ends of longitudinal chain sections 35 linked to the transverse chain section parts are spaced apart a distance a little greater than the length of ties 11. The spread transverse chain section is then lowered into the space below the track from which the ballast has been removed, suitable drives linking chain 18 to machine frame part 2 to enable the endless ballast excavating chain to be vertically adjusted in a well known manner. The raised track section is then lowered again by operation of track gripping clamps 27 and the track rails are reconnected. The reconnected rails are then gripped by track lifting device 13 and the track is slightly raised for continuous operation of the machine as it advances along the track in the operating direction indicated by arrow 26, i.e. endless ballast excavating chain 18 is rotated to excavate ballast and convey it to conveyor band arrangement 20 for conveyance to screening arrangement 28 whence the cleaned ballast is redistributed by cleaned ballast conveyor band arrangement 22. All of these structures and their operation are well known in ballast cleaning machines.

The spacing between pivot pin 17 of longitudinally displaceable undercarriage 12 and pivoting axis 6 causes first machine frame part 2 to be laterally outwardly displaced in the direction of the curvature, particularly in sharp track curves. This enables endless ballast excavating chain also to be displaced in the same direction so that track 31, which is eccentrically positioned with respect to machine frame part 2, may still be encircled by endless chain 18. Longitudinal adjustment of undercarriage 12 between its two end positions into intermediate positions enables the position of machine frame part 2 and endless chain 18 to be adapted advantageously to prevailing operating conditions.

If desired, rear undercarriage 9 may be longitudinally displaceable in the same manner as front undercarriage 12 or, alternatively, only rear undercarriage 9 may be longitudinally displaceable, i.e. at least one of the undercarriages arranged on one of the machine frame parts in the range of the vertical pivoting axis pivotally linking adjoining machine frame part ends is longitudinally displaceable.

What is claimed is:

1. A ballast cleaning machine for excavating ballast from underneath a track and for receiving, cleaning and transporting the excavated ballast, which comprises (a) a machine frame comprising two frame parts, each machine frame part having opposite ends,
  (1) one of the ends of one machine frame part adjoining one of the ends of the other machine frame part while the machine frame part ends opposite to the one ends are remote from each other, and
  (2) the adjoining machine frame part ends being pivotally linked to each other for pivoting about a vertical axis, (b) respective undercarriages supporting the machine frame on the track,
  (1) two of the undercarriages being arranged at the remote machine part ends and
  (2) a third one of the undercarriages being arranged on one of the machine frame parts in the range of the vertical pivoting axis, (c) an endless ballast excavating chain arranged on a first one of the machine frame parts, the chain including
  (1) a transverse section extending for operation under the track, (d) a ballast screening arrangement arranged to receive excavated ballast from the chain, (e) a track lifting device arranged on the first machine frame part adjacent the transverse ballast excavating chain section, and (f) a drive connecting the third undercarriage to the one machine frame part whereon it is arranged for longitudinally displacing the third undercarriage along the track whereby the spacing between the third undercarriage and the track lifting device may be varied.

2. The ballast cleaning machine of claim 1, wherein the endless ballast excavating chain comprises two longitudinally extending sections linked to the transverse chain section, the transverse chain section consisting of two parts pivotally linked to each other for pivoting about a vertical center axis whereby the longitudinally extending chain sections may be pivoted into a position closely adjacent respective sides of the one machine frame part whereon the chain is mounted.

3. The ballast cleaning machine of claim 1, wherein the one machine frame part pivotally linked to the first machine frame part has the third undercarriage arranged at a rear end of the one machine frame part, in an operating direction of the machine, and the ballast screening arrangement is mounted on the one machine frame part.

4. A ballast cleaning machine for excavating ballast from underneath a track and for receiving, cleaning and transporting the excavated ballast, which comprises (a) a machine frame comprising two frame parts, each machine frame part having opposite ends,
  (1) one of the ends of one machine frame part adjoining one of the ends of the other machine frame part while the machine frame part ends opposite to the one ends are remote from each other, and
  (2) the adjoining machine frame part ends being pivotally linked to each other for pivoting about a vertical axis, (b) respective undercarriages supporting the machine frame on the track,
  (1) two of the undercarriages being arranged at the remote machine part ends and
  (2) a third one of the undercarriages being arranged on one of the machine frame parts in the range of the vertical pivoting axis, the third undercarriage comprising two swivel trucks and a carrier plate connecting the swivel trucks, (c) an endless ballast excavating chain arranged on a first one of the machine frame parts, the chain including (1) a transverse section extendig for operation under the track, (d) a ballast screening arrangement arranged to receive excavated ballast from the chain, (e) a track lifting device arranged on the first machine frame part adjacent the transverse ballast excavating chain section, (f) a drive connecting the third undercarriage to the one machine frame part whereon it is arranged for longitudinally displacing the third undercarriage along the track whereby the spacing between the third undercarriage and the track lifting device may be varied, (g) a support plate connected to the drive and having two side edges, and (h) a longitudinally extending guide on the one machine frame part glidingly receiving the support plate side edges, (1) the carrier plate being rotatably mounted on the support plate.

5. The ballast cleaning machine of claim 4, wherein the longitudinally extending guide is constituted by two guide tracks of U-shaped cross section defined in the one machine frame part.

6. The ballast cleaning machine of claim 4, further comprising respective pivot pins rotatably mounting the swivel trucks on the carrier plate, and the third undercarriage having a longitudinal displacement path corresponding to the spacing between the pivot pins of the swivel trucks.

7. A ballast cleaning machine for excavating ballast from underneath a track and for receiving, cleaning and transporting the excavated ballast, which comprises (a) a machine frame comprising two frame parts, each machine frame part having opposite ends, (1) one of the ends of one machine frame part adjoining one of the ends of the other machine frame part while the machine frame part ends opposite to the one ends are remote from each other, and (2) the adjoining frame part ends being pivotally linked to each other for pivoting about a vertical axis, (b) respective undercarriages supporting the machine frame on the track, (1) two of the undercarriages being arranged at the remote machine part ends and (2) a third one of the undercarriages being arranged on one of the machine frame parts in the range of the vertical pivoting axis and being rotatable about a vertical axis, (c) an endless ballast excavating chain arranged on a first one of the machine frame parts, the chain including (1) a transverse section extendig for operation under the track, (d) a ballast screening arrangement arranged to receive excavated ballast from the chain, (e) a track lifting device arranged on the first machine frame part adjacent the transverse ballast excavating chain section, and (f) a drive connecting the third undercarriage to the one machine frame part whereon it is arranged for longitudinally displacing the third undercarriage along the track whereby the spacing between the third undercarriage and the track lifting device may be varied, (1) the drive being arranged for longitudinally displacing the third undercarriage between a first position for moving the machine between operating sides, wherein the vertical axes are coaxial and the vertical rotating axis of the third undercarriage extends below the vertical pivoting axis of the machine frame parts, and a second position for operating the machine at respective ones of said sides, wherein the vertical rotating axis of the third undercarriage leads the vertical pivoting axis of the machine frame parts in an operating direction of the machine.

* * * * *